United States Patent [19]

Starr

[11] 4,309,976

[45] Jan. 12, 1982

[54] WOOD HEATER

[76] Inventor: Mark E. Starr, P.O. Box 89, Coeur d'Alene, Id. 83814

[21] Appl. No.: 130,742

[22] Filed: Mar. 17, 1980

[51] Int. Cl.[3] ..... F24C 1/00; F24B 7/00

[52] U.S. Cl. ..... 126/61; 237/55

[58] Field of Search ..... 126/61; 237/55

[56] References Cited

U.S. PATENT DOCUMENTS

| | | | |
|---|---|---|---|
| 60,760 | 11/1867 | Loomis | 237/55 |
| 2,902,265 | 9/1959 | Dubovick | 237/55 |
| 4,117,883 | 10/1978 | Feldmann | 237/55 |
| 4,127,100 | 11/1978 | Baker | 126/61 |
| 4,128,094 | 12/1978 | Lewis | 126/61 |
| 4,136,662 | 1/1979 | Willson | 126/61 |
| 4,171,089 | 10/1979 | Schossow | 237/55 |

*Primary Examiner*—Samuel Scott
*Assistant Examiner*—Wesley S. Ratliff, Jr.
*Attorney, Agent, or Firm*—Wells, St. John & Roberts

[57] ABSTRACT

A wood heater having an elongated cylindrical firebox with a door access at one end. A secondary heat chamber is located on a top side of the firebox, interconnecting the firebox to a flue adapter ring. Hot combustion gases are directed from the firebox through the second heat chamber to the flue adapter ring. A heat exchanger is positioned above the firebox within the heat chamber to extract heat from the burning gases and to direct the heat outwardly of the firebox and into the adjacent room. A window case protrudes from one side of the firebox and includes a glass pane for viewing the fire. The window case includes a shutter plate assembly that selectively closes off the fire from view through the window. The shutter plate has the additional function of directing ventilation air from the window vent aperture to cool the glass within the window case, protecting the glass pane from excessive heat, and preventing build-up of soot along the inwardly exposed surface thereof.

8 Claims, 8 Drawing Figures

WOOD HEATER

BACKGROUND OF THE INVENTION

The present invention relates to wood heaters with a mechanism by which the enclosed fire may be selectively viewed.

Open hearth fireplaces are aesthetically appealing but are ineffective sources of primary or secondary heat. Wood heaters that allow controlled ventilation to the fire are much more effective if not pleasing in appearance. It therefore becomes desirable to provide some form of wood heater that presents the capability of heating effectively as a wood stove yet allows selective viewing of the fire.

Various unsuccessful attempts have been made to combine the aesthetic appeal of the fireplace with the higher heating efficiency of "air-tight" wood stoves.

Many attempts have resulted in the unattractive free-standing fireplaces with removable metal or glass doors. Such apparatus do not include effective heat exchange capabilities or effective damper or draft arrangements.

U.S. Pat. No. 3,757,766 to Robert L. Stevenson discloses a wood heater with a viewing window and enclosed collapsible door that is adapted to open or close, with the closed position shielding the window from the interior of the adjacent firebox. The collapsible door is operated by control knobs that are found behind exterior doors at opposite ends of the window housing. The controls include knobs that slide within inverted L-shaped slots formed through the window housing. These open slots are found behind access doors mounted at opposite ends of the window housing. The doors selectively close so an undesired draft is not produced through the open slots. A ventilator is positioned along a top side of the window housing that is also selectively closed by a door structure. There is no provision for guiding the ventilation air other than the shape or position of the slot itself. The firebox is substantially cylindrical and has no provision for heat exchange other than by natural convection.

The "Thermo-Blaze" fireplace heating systems sold by Gorich Associates, Inc. of Brockton, Mass. is a combination fireplace-heater that is similar to the Stevenson unit. The "Thermo-Blaze", however, has a "roll-top" door that selectively seals the viewing window from the fire. In addition, a shroud is provided partially about the back and top surfaces of the cylindrical firebox for the purpose of guiding air directed from a blower unit. The air is circulated over the heated surface of the firebox and is exhausted forwardly of the firebox unit.

With both of the above heaters, heat is conducted through the window housing directly to the window pane. Glass can be broken or cracked when the viewing doors are closed with no ventilating air being allowed to circulate over the glass. Heat is conducted through the housing and radiated from the viewing doors against the glass and can eventually cause damage or breakage, especially when fires are "banked" to last through the night.

and

Figure 2:
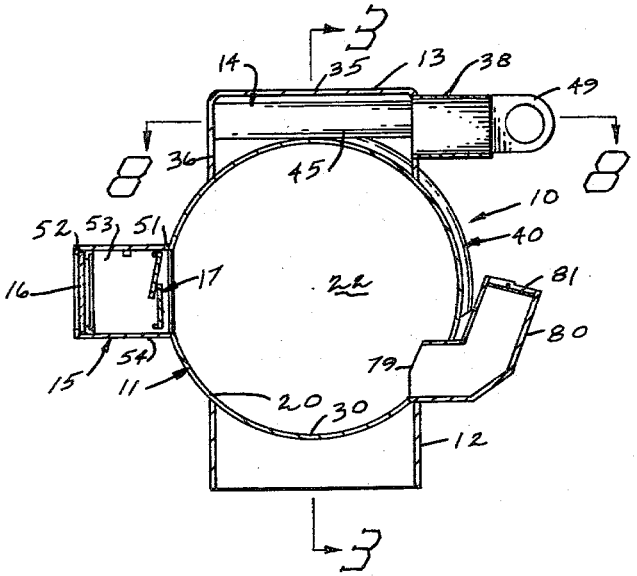
FIG. 2 is a transverse sectional view taken along line 2—2 in FIG. 7.
Figure 8:
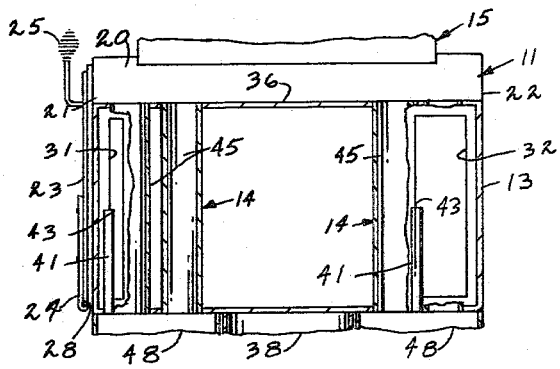

FIG. 8 is a sectional view taken substantially along line 8—8 in FIG. 2.

DETAILED DESCRIPTION OF A PREFERRED EMBODIMENT

The present wood heater is generally designated in the accompanying drawings by the reference character 10. The present wood heater 10 basically includes an elongated firebox 11 mounted to a rigid base 12. A secondary heat chamber 13 is situated atop the firebox 11 interconnecting the firebox interior with a flue adapter ring. A heat exchanger 14 is situated within the secondary heat chamber to direct heated air into the adjacent room. A window case 15 projects outwardly from the firebox to mount a glass pane 16 at an outward end thereof. A shutter assembly 17 is situated within the window case between the pane 16 and firebox 11 to selectively isolate the glass pane 16 from the firebox interior.

Figure 3:
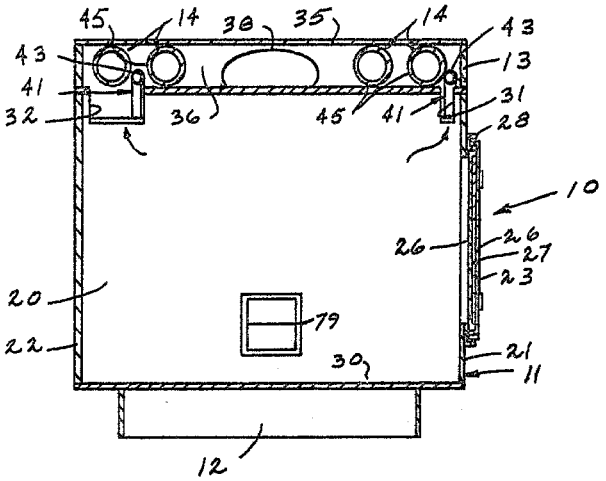
FIG. 3 is a longitudinal sectional view taken along line 3—3 in FIG. 2.

Additional details of the firebox 11 are shown with reference to FIGS. 2, 3 and 8. As shown, the firebox 11 is formed as an elongated cylinder having a substantially horizontal central axis. The firebox includes cylindrical peripheral walls 20 that extend longitudinally between an end 21 and a parallel opposite end wall 22. A door 23 is hinged at 24 to the end wall mechanism 25.

Construction of the door 23 is made specifically to avoid warpage due to excessive heat within the firebox. To this end, the door is formed by two spaced door plates 26 (FIG. 3) that sandwich a heat insulation material such as asbestos 27. The rectangular perimeter of the door 23 fits within a complementary channel frame 28. The frame 28 is affixed to the end wall and receives a sealing material such as asbestos tape that provides an airtight seal with the engaged portion of the door perimeter.

The interior of the firebox 11 is cylindrical as is the outside longitudinal surface. The cylindrical interior defines the area in which a fire is held and in which wood is received through the door 23. The lower or bottom portions of the firebox 11 define the bed 30 (FIGS. 2 and 3) for supporting the combustible materials. The bed 30 may be aligned with appropriate firebrick (not shown) or other material that provides adequate heat resistant properties. The natural curvature of the bed 30 causes the logs to roll inwardly onto themselves so the logs will remain "banked" as they burn.

Opposite the bed 30 is the top of the firebox which includes a transverse slot 31 adjacent the end wall 21 and a second larger slot 32 is situated adjacent the opposite end wall 22 (FIGS. 3 and 8). The slots 31 and 32 open directly into the secondary heat chamber 13 for the purpose of allowing escape of burned and unburned flue gases into the secondary heat chamber. The first slot 31 is substantially smaller in width than the second slot 32.

When the door 23 is opened, there is a tendency for smoke to rush toward the larger slot 32 rather than billowing out through the open doorway.

The slots 31 and 32 are substantially rectangular, following the curvature of the cylindrical peripheral walls 20 along an upper segment. All combustion gases, burned or unburned, are directed through the two slots 31 and 32 and into the secondary heat chamber.

The secondary heat chamber 13 is affixed to the top of the firebox 11, covering the first and second slots 31 and 32. The heat chamber 13 is substantially rectangular with a flat top surface 35 and upright peripheral walls 36. The top surface is spaced above the adjacent top surface of the firebox 11 to produce a chamber that is open only at the slots 31 and the flue adapter ring 38.

The flue adapter ring 38 is shown to project horizontally from a rearward wall 36 of the secondary heat chamber 13. It is practical in some instances to provide the flue adapter ring 38 with a vertical orientation. The adapter ring 38 could then be mounted to the horizontal top surface 36 of the secondary heat chamber.

Regardless of its position, the flue adapter ring is provided to adapt the heater for connection to a standard chimney and to receive and direct burned gases of combustion from the secondary heat chamber into the associated chimney (not shown). Various sizes and shapes of flue adapter rings 38 may be provided to conform with various chimney and building code requirements.

Figure 7:
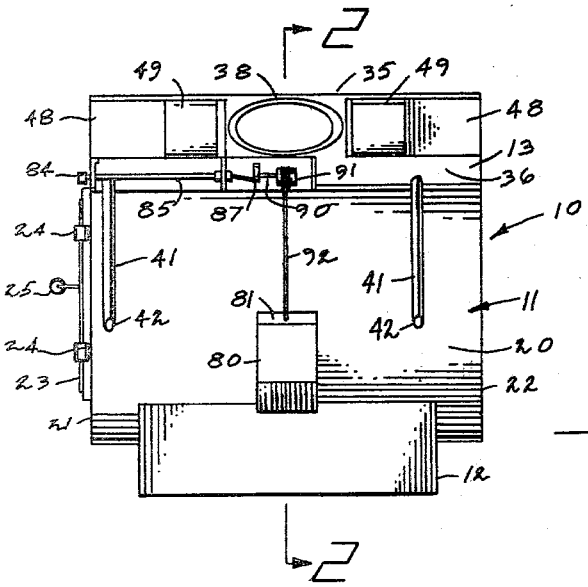
FIG. 7 is a rear elevational view of the present wood heater.

A secondary air bleed means may be provided to direct small amounts of fresh air into the secondary heat chamber to support secondary combustion therein. The secondary air bleed means is comprised of a pair of pipes 41 that are fixed flush against the firebox wall 20, curving upwardly from outside exposed bottom ends 42 (FIG. 7) to top ends 43 situated within the secondary heat chamber 13 (FIG. 3). The top ends 43 and bottom ends 42 are open and allow passage of air from outside the heater 10 into the secondary heat chamber at positions directly adjacent the slots 31 and 32.

Cool air is drawn into the lower or bottom ends of the pipes 41 by natural conduction and in addition, by venturi action of gases passing over the open upper ends. The firebox wall 20 heats the incoming air as it moves up within the pipes. The temperature of air within the pipes 41 is raised to a point sufficient to permit secondary combustion of unburned flue gases within the secondary heat chamber 13. The heated fresh air is ejected directly into the ascending path of unburned flue gases as they pass through the slots 31 and 32. The result is a secondary combustion produced within the secondary heat chamber, completing the combustion process started with combustible material in the firebox below.

Heat is extracted both from the firebox and from the secondary heat chamber and directed outwardly into the adjacent room by the heat exchanger 14. The heat exchanger is shown in particular detail again with reference to FIGS. 2, 3 and 8. It includes a number of transverse hollow heat tubes 45 that lead through the secondary heat chamber 13. The hollow tubes 45 each have open forward ends 46 and open rearward ends 47. The ends 46 and 47 project through the vertical perimeter walls 36 of the secondary heat chamber 13. Therefore, air is free to pass from one end of the tubes to the other end without coming into direct contact with the heated flue gases within the secondary heat chamber.

It is pointed out that the location of the transverse hollow tubes 45 is above the firebox 11 and within the secondary heat chamber 13. The tubes 45 do not interfere with combustion processes within the firebox 11. Furthermore, the tubes 45 are positioned within the secondary heat chamber 13 to extract a maximum amount of heat from the burned and burning flue gases within the heat chamber 13 before it passes into and through the flue adapter ring 38.

The rearward ends 47 of the transverse hollow tubes 45 may be connected to manifolds 48. As shown, there are two manifolds 48, each connecting the rearward ends 47 of two tubes 45. However, if the flue adapter ring 38 is positioned along the top 35 of heat chamber 13, a single longitudinal manifold may be provided connecting all exposed ends 47 of the tubes 45.

A blower 49 is provided for each manifold 48. The blowers 49 are connected at their discharge ends to the manifold so they may draw cool air through their exposed intakes and discharge it into the manifolds 48. Manifolds 48 direct the air through the tubes 45 and out into the adjacent room. Of course, if a single manifold is used, a single blower can be used.

The window case 15 projects horizontally outward of the firebox 11 from an inner open end 51 to an outwardly spaced outer end 52 (FIG. 2). The inner end 51 is open, exposing inner portions of the window case to the firebox interior. The opening is covered at the outer end 52 by the glass pane 16.

The window case 15 is substantially rectangular with its width dimension extending longitudinally with respect to the length dimension of the firebox. The case includes integral vertical end walls 53 joined by vertically spaced horizontal top and bottom walls 54. The end walls 53 are formed to conform with the cylindrical curvature of the peripheral firebox walls 20.

Figure 4:
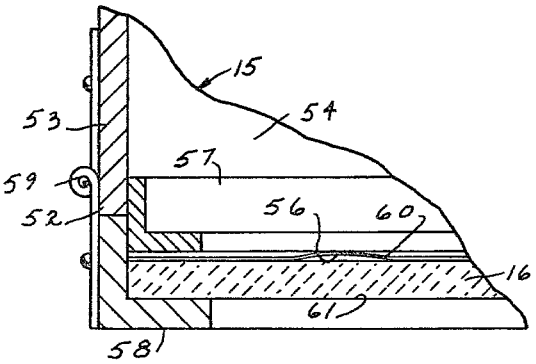
FIG. 4 is an enlarged fragmentary view illustrating the window pane and mounting assembly.

The outer end 52 of the window case 15 includes a slot 56 (FIG. 4) formed by integral portions of the walls 53 and 54 and an inwardly spaced frame 57. The slot 56 is covered at one end wall by a hinged access door 58. The door 58 is hinged at 59 to selectively open, allowing access to the glass pane 16 held within the slot 56. The pane 16 may be slid longitudinally into or out of the slot 56. The access door 58 mates along its edges with corresponding surfaces of the window case 15 so a substantially airtight seal is formed when the door is closed.

The slot 56 is provided with a number of leaf springs 60 (FIG. 4) that engage the glass pane 16 and urge it outwardly against an outward wall 61 of the slot. The leaf springs 60 are positioned along the slot 56 through the lengths of the top and bottom case walls 54. The springs 60 allow differential expansion and contraction, twisting or warp between the metal window case 15 and glass pane 16 to prevent damage or breakage of the glass. In addition, the outwardly urged glass will deflect inwardly in response to accidental inward impact. The glass will deflect the springs inwardly rather than shatter or crack.

A shutter assembly 17 (FIGS. 1, 5 and 6) is situated within the case adjacent its inner open end 51 and is manually operable to close off the open end, sealing the glass pane from exposure to fire within the firebox.

Figure 1:
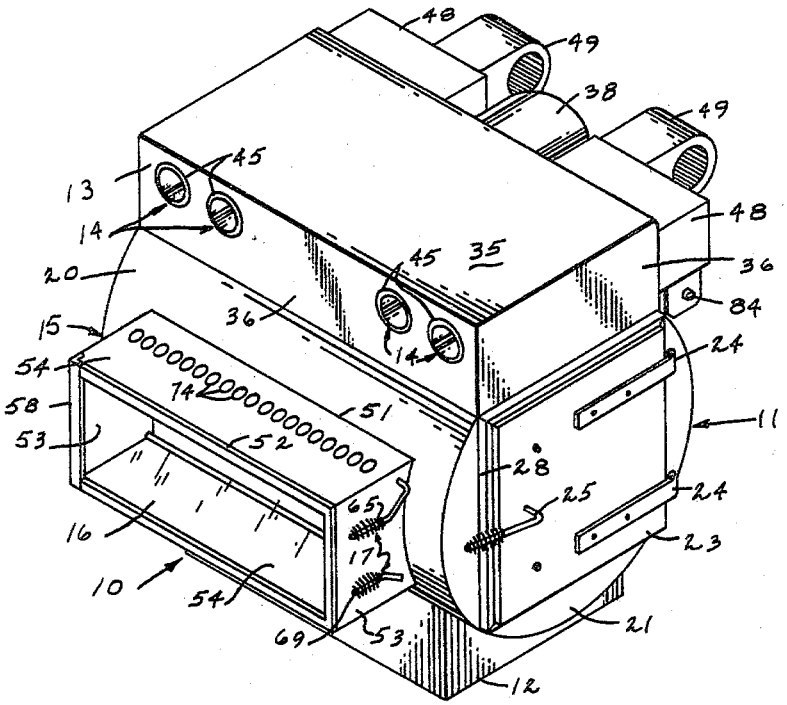
FIG. 1 is a pictorial view of the present wood heater.

The shutter assembly 17 is comprised of at least one, but preferably two butterfly shutter plates. A top shutter plate 63 is mounted to a pivot rod 64 that extends horizontally the width of the window case 15 and is pivotably mounted thereto. An end of the pivot rod 64 extends outwardly to a manually operated handle 65 (FIG. 1). The handle 65 may be turned to move the associated shutter plate 63 between a substantially vertical closed position (FIG. 6) and an open position (FIG. 5).

A second bottom shutter plate 67 is situated directly below the top plate 63. The shutter plate 67 is mounted to a horizontal pivot rod 68. The rod 68 is situated adjacent the bottom wall of the window case 15 and is parallel to the top pivot rod 64. The pivot rod 68 extends outwardly to a handle 69 (FIG. 1) that operates similarly to the handle 65, manually pivoting the shutter plate 67 between an upright closed position (FIG. 6) and a substantially horizontal open position (FIG. 5).

Figure 5:
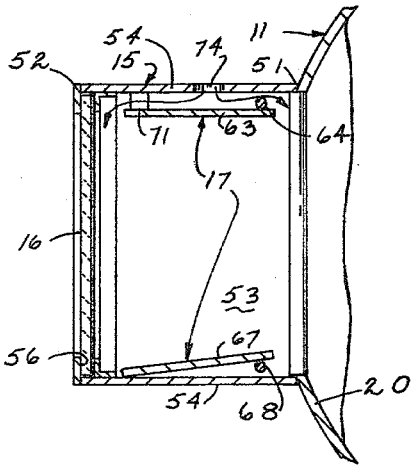
FIG. 5 is an enlarged fragmented section of the window case and shutter assembly.
Figure 6:
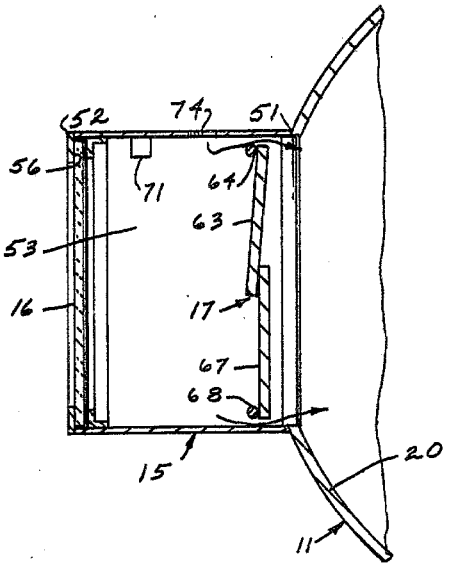
FIG. 6 is a view similar to FIG. 5 only showing the shutter assembly in a closed position.

An abutment 71 is affixed to the window case in the pivot path of the shutter plate 63 (FIGS. 5 and 6). The abutment 71 prevents pivotal movement of the shutter plate 63 beyond the horizontal position shown in FIG. 5. The abutment 71 therefore spaces the plate 63 a slight distance from the corresponding top surface 54 of the case 15, leaving an open air space therebetween.

Vent 74 is formed through the window case 15 along the top wall 54 thereof. The vent 74 may actually be comprised of a plurality of apertures formed through the wall opening into the inner confines of the window case. The apertures 74 are situated along the case 15 between the inner case end 51 and glass pane 16 directly above the shutter plate 63 when it is pivoted to the open FIG. 5 position. The open shutter plate 63 therefore acts as a baffle and guide for air entering through the vent 74.

The vent 74 functions to supply air for combustion within the firebox 11. Such entering air is also used to cool the glass pane 16 and to keep the inner surface of the pane relatively free of soot build-up from the fire. Directional arrows in FIG. 5 indicate the directions taken by air entering through the vent 74 when the upper shutter plate 63 is in its open position. Part of the air is directed outwardly and downward as it comes into contact with the inner facing surface of the glass pane 16. Part of the air is drawn inwardly to the firebox through a somewhat confined space between the rod 64 and top wall 54 of the window case.

When the shutter plates 63 and 67 are closed (FIG. 6) air entering through the vent apertures 74 is allowed to bleed into the firebox between the rods 64, 68 and the adjacent top and bottom walls 54 of the window case. The air bleeding through these areas serves to minimize heat conduction through the window case outwardly to the glass pane. In addition, it provides additional fresh air that is heated prior to entry into the firebox to support secondary combustion both within the firebox and within the secondary heat chamber. The air bled into the firebox by passing over the rods 64 and 68 is heated by contact with the heated surfaces at the juncture of the window case and firebox.

A damper means (FIGS. 2, 3 and 7) is provided on a side of the firebox opposite the window case to allow control flow of air into the firebox. The damper means is preferably thermostatically controlled. The damper means includes a duct opening 79 (FIG. 2) that is situated at the approximate longitudinal center of the firebox and adjacent to the fire bed 30. An outside tubular duct 80 extends from the duct opening 79 upwardly outside the firebox. The duct 80 mounts a pivoted butterfly damper plate 81 therein. The damper plate 81 pivots within the duct 80 between open and closed positions. The plate 81 is shown closed in FIG. 2.

A thermostat assembly may be provided to thermostatically control the amount of air flow into the firebox. Such a control may include an adjusting knob 84 (FIG. 7) situated at the end of the firebox adjacent the door 23. The knob 84 is connected to a control rod 85 that extends longitudinally along the firebox to an end above the tubular duct 80. The rod is connected to a bi-metal spring 87 so that turning of the knob 84 will produce a change in torsional loading of the bi-metal spring 87. Such loading will affect its expansion and contraction due to temperature fluctuations at the area directly adjacent the secondary heat chamber. A pulley shaft 90 is connected to the bi-metal spring and rotates in response to expansion and contraction of the spring. The pulley shaft 90 is affixed to a pulley 91 that receives a length of chain 92 or other flexible connector. The chain 92 extends between the pulley 91 and the damper plate 81. Expansion and contraction of the bi-metal spring 87 will therefore cause corresponding pivotal movement of the damper plate 81 between its open and closed positions.

Operation of the present wood heater may now be easily understood with reference to the above description and attached drawings.

Prior to operation, the present wood heater is connected in the conventional manner to a chimney. Various conventional forms of flue pipe connectors are available that can interconnect the flue adapter ring 38 to standard forms of chimneys or flue pipe.

After the heater is properly installed, a fire may be started within the firebox 11. This is accomplished by closing the shutter assembly to the FIG. 6 position, setting the thermostat control at a desired temperature setting, and opening the door 23. Combustible material, usually paper, kindling and firewood are placed within the firebox on the bed 30. The combustible material is then ignited and the door 23 is securely closed. The firebox will immediately start heating with the fire being fed combustion air primarily through the damper means 78. Once the fire is started, the shutter assembly 17 may be opened to allow viewing of the fire within.

As the fire grows and continues to heat the surface areas of the present heater, secondary combustion begins to take place within the secondary heat chamber 13. The hot surfaces of the firebox serve to heat air being drawn upwardly through the secondary bleed pipes 41. The air reaches a sufficient temperature to support secondary combustion within the chamber 13 shortly before it is exhausted into the chamber and mixes with the flue gases entering the chamber through the slots 31 and 32. Efficient and nearly complete combustion of the fire wood is therefore experienced in the firebox and secondary heat chamber before the flue gases are allowed to escape through the adapter ring 38.

The heat produced by primary and secondary combustion is radiated from the heated walls of the firebox and is exchanged into the surrounding air by the heat exchanger 14. The blowers 49 may be appropriately thermostatically controlled to activate once the temperature within the manifolds or heat tubes reaches a prescribed temperature. Once activated, the blowers draw cool air from outside the heater into the manifolds and subsequently outwardly through the heat pipes. The heat tubes are constantly heated by the hot burned and burning flue gases within the secondary heat chamber and so air passing therethrough absorbs much of the heat of combustion. The heated air is forced outwardly into the adjacent room and is eventually circulated back through the blower.

It is advisable that the shutter assembly be shifted to the closed position when the unit is to be used exclusively as a wood heater or when the heater is to be left unattended for extended periods of time (overnight).

The above description and attached drawings exemplify a preferred form of my invention. Other forms of my invention fall within the scope of my invention which is more specifically set out in the following claims.

What I claim is:

1. A wood heater, comprising:

a base;

an elongated horizontal firebox on the base having a hollow interior defined by longitudinal side walls joined by transverse end walls;

open first and second slots formed through the side walls adjacent the transverse end walls and opening into the hollow firebox interior;

a secondary heat chamber affixed to the firebox along the longitudinal side walls and covering the slot so the hollow interior of the firebox is separated from the secondary heat chamber by the side walls and communicates with the interior of the secondary heat chamber through the slots;

a flue adapter ring mounted to the secondary heat chamber between the slots for receiving combustion gases therefrom and for directing the combustion gases away from the heater;

a door on one of the end walls adapted to be opened to allow access to the firebox interior; and heat exchanger means within the secondary heat chamber between the slots and flue adapter ring for directing heat from combustion gases passing from the slots to the adapter ring, outwardly of the firebox; and secondary air bleed means on the firebox leading into the secondary heat chamber adjacent the first and second slots for preheating and directing air into the secondary heat chamber to support secondary combustion of unburned gases therein.

2. The wood heater as defined by claim 1 further comprising thermostatically controlled damper means on the firebox separate from the secondary air bleed means selectively operable to allow controlled flow of air into the firebox below the secondary heat chamber from a side thereof opposite the window case.

3. The wood heater as defined by claim 1 wherein the firebox is cylindrical with a horizontal central axis and wherein the secondary heat chamber includes a rectangular compartment formed along a top side of the cylindrical firebox; and wherein the first slot is formed through the side walls adjacent the door in open communication with the rectangular compartment, and the second slot is formed through the firebox at an opposite end thereof in open communication with the rectangular compartment; and wherein the heat exchanger includes heat tubes extending transversely through the rectangular compartment above the firebox having ends opening outside the compartment to allow free flow of outside air therethrough.

4. The wood heater as defined by claim 3 wherein the second slot is larger than the first slot.

5. The wood heater as defined by claim 3 further comprising blower means connected to the heat tubes for forcing air through the heat tubes.

6. The wood heater as defined by claim 1 further comprising a damper vent formed through the firebox side wall opposite the window case; and a butterfly damper plate pivoted to the firebox side wall selectively operable to open or close the damper vent.

7. The wood heater as defined by claim 1 wherein the window frame is slotted longitudinally to slidably receive the glass pane and is provided with spring means to yieldably urge the glass pane outwardly against edges of the slot.

8. The wood heater as defined by claim 7 further comprising hinged door means on the window case operable to allow access to the glass pane and slot for removal and replacement of the glass pane within the slot.

* * * * *